US005558466A

United States Patent [19]

Kuo et al.

[11] Patent Number: 5,558,466

[45] Date of Patent: Sep. 24, 1996

[54] DIVING MASK WITH A STRUCTURE FOR DRAIN AND FLOW GUIDE

[76] Inventors: Tzong-Fu Kuo, No35, Cheng long Lane, Sec. 2, San Ming Rd., Pan Chiao city, Taipei Hsien; Le-Jang Feng, 1 Fl., No. 22-10, Lane 50, Tien Mu E. Rd., Taipei, both of Taiwan

[21] Appl. No.: 437,590

[22] Filed: May 9, 1995

[51] Int. Cl.[6] ..... A61F 9/02

[52] U.S. Cl. ..... 405/186; 128/200.29

[58] Field of Search ..... 405/186, 193, 405/192; 128/201.25, 201.27, 201.28, 200.29

[56] References Cited

U.S. PATENT DOCUMENTS

| | | | |
|---|---|---|---|
| 2,435,653 | 2/1948 | Maurer | 128/207.13 X |
| 3,845,768 | 11/1974 | Garrahan | 128/201.27 X |
| 3,995,627 | 12/1976 | O'Neill | 128/201.27 X |
| 4,856,120 | 8/1989 | Hart | 2/428 |
| 5,329,643 | 7/1994 | Sato | 2/428 |
| 5,479,917 | 1/1996 | Hsieh | 128/200.29 |

*Primary Examiner*—Frank Tsay

[57] ABSTRACT

A diving mask with a drain port on the lower front of a nose on the frame body of the mask. A flow guide tube is connected to the drain port and bent toward the lower edge of the nose. The flow guide tube of the drain port is provided with a check drain valve which uses the flow guide action of the flow guide tube to smoothly guide the water and the air blown out by the diver so that it flows to the lower edge of the diving mask without water diffusion. The diving mask also includes a fixing cover to cover the flow guide tube and nose so that the flow guide tube can be stably engaged with the nose.

5 Claims, 5 Drawing Sheets

DIVING MASK WITH A STRUCTURE FOR DRAIN AND FLOW GUIDE

BACKGROUND OF THE INVENTION

1. Field of the Invention

The present invention is related to a diving mask and more particularly is a diving mask with a structure for a drain and flow guide capable of very easily draining the water accumulated in the diving mask.

2. Description of the Prior Art

As one of the diving appliances necessary for the diver, the diving mask can help the diver clearly see in the water and fully protect the diver's eyes.

The inner lining of a diving mask in general is made of soft rubber so as to tightly and closely contact the diver's face. However, people's faces vary from each other, and sometimes the diving mask and the diver's face cannot entirely and closely contact each other. In this case, water will seep into the diving mask through the point where the diving mask fails to closely contact the diver's face. When too much water has accumulated in the diving mask, the diver's respiration and vision will be affected.

Therefore, the diver has to first learn how to drain his mask. In the case of a diving mask without a drain valve, the diver has to use his hand to press the upper edge of the diving mask and open the lower edge thereof and simultaneously exhale so as to blow out the water accumulated in the diving mask from the lower edge of the diving mask by means of the pressure of his exhalation. However, such a practice requires skillful technique.

In addition, in the case of a diving mask with a drain valve, the diver can directly exhale so as to directly blow out the water accumulated in the diving mask from the drain valve. However, as soon as the water blown out passes through the drain valve, it diffuses so that it is difficult for the diver to expel it. The diver has to blow the water many times and forcefully. Such a practice is very inconvenient, and in forcefully blowing out the water many times, the diver tends to suffer vertigo. Furthermore, the bubbles derived from mixing the air and the blown-out water will float upward across the lens surface on the front of the diving mask and restrict the diver's vision.

Now there is a kind of diving mask on the market as shown in FIG. 1, comprising a bent portion between two sides that enlarges gradually from the upper side to the lower side and extends upward in the central zone on the lower side of the body frame. A lens is inserted into the lower perimeter of the body frame covering the bent portion, and a drain valve protrudes from the bent portion. Two separate nose clips on the two sides of the central zone at the bottom extend rearward from the body frame.

The diving mask of the prior art essentially offers a nose frame with a different appearance (V-shaped) and a drain port on the lower side edge of the large nose cover. Such a design is very effective for preventing the bubbles from passing across the lens surface on the front of the diving mask because the blown-out bubbles will float upward through the two sides of the diving mask from the drain port on the lower side edge but not affect the diver's line of sight. However, so far as decreasing the number of times the diver must expel water or reducing the effort required to do so, the extent of the prior art's improvement is limited for the following reasons: a large space (A) is formed between the nose cover and the valve seat. As soon as the blown-out water passes through the valve seat, it diffuses in the space which has no means to concentrate and direct the water and air. The water stagnates, and the diver has to forcefully blow the water so as to drain it. In addition, the blown-out water will first collide with the inner side plate of the nose cover to cause a rebound effect.

SUMMARY OF THE INVENTION

In view of the drawbacks of the foregoing prior art diving masks, the object of the present invention is to offer a diving mask with a structure for a drain and flow guide which will let a diver easily and smoothly drain the water accumulated in the diving mask.

The present invention comprises a drain port on the lower front of a nose on the frame body of a diving mask. A flow guide tube is connected to the drain port and bent toward the lower edge of the nose. The flow guide tube of the drain port is provided with a check drain valve which uses the flow guide action of the flow guide tube to smoothly guide the water ad the air blown out by the diver so that it flows to the lower edge of the diving mask without water diffusion.

The present invention further comprises a fixing cover to cover the flow guide tube and nose so that the flow guide tube can be stably engaged with the nose.

DETAILED DESCRIPTION OF THE PREFERRED EMBODIMENTS

Figure 1:
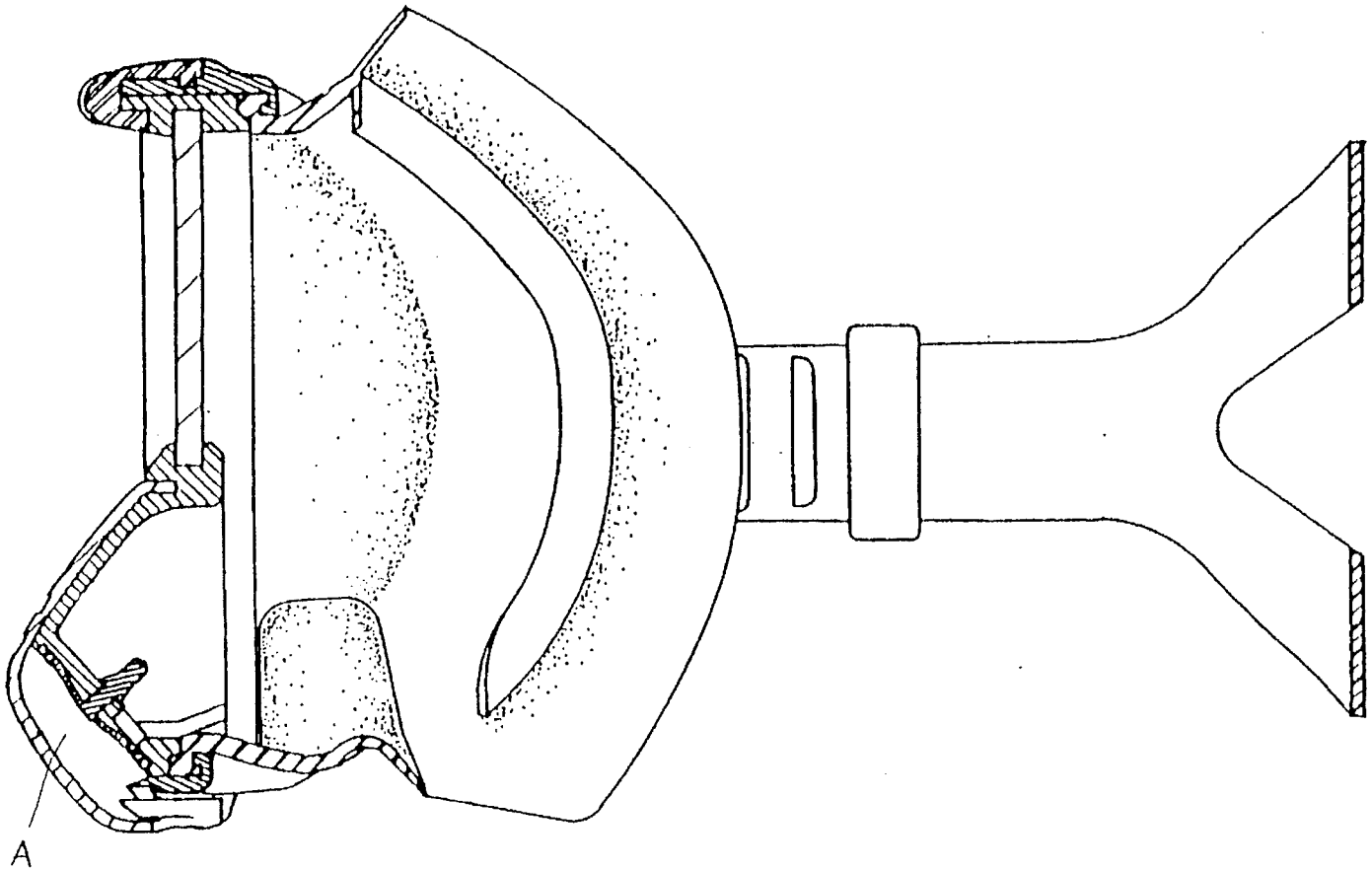
FIG. 1 (Prior Art)
FIG. 1 is a section view of a diving mask of the prior art.
Figure 2:
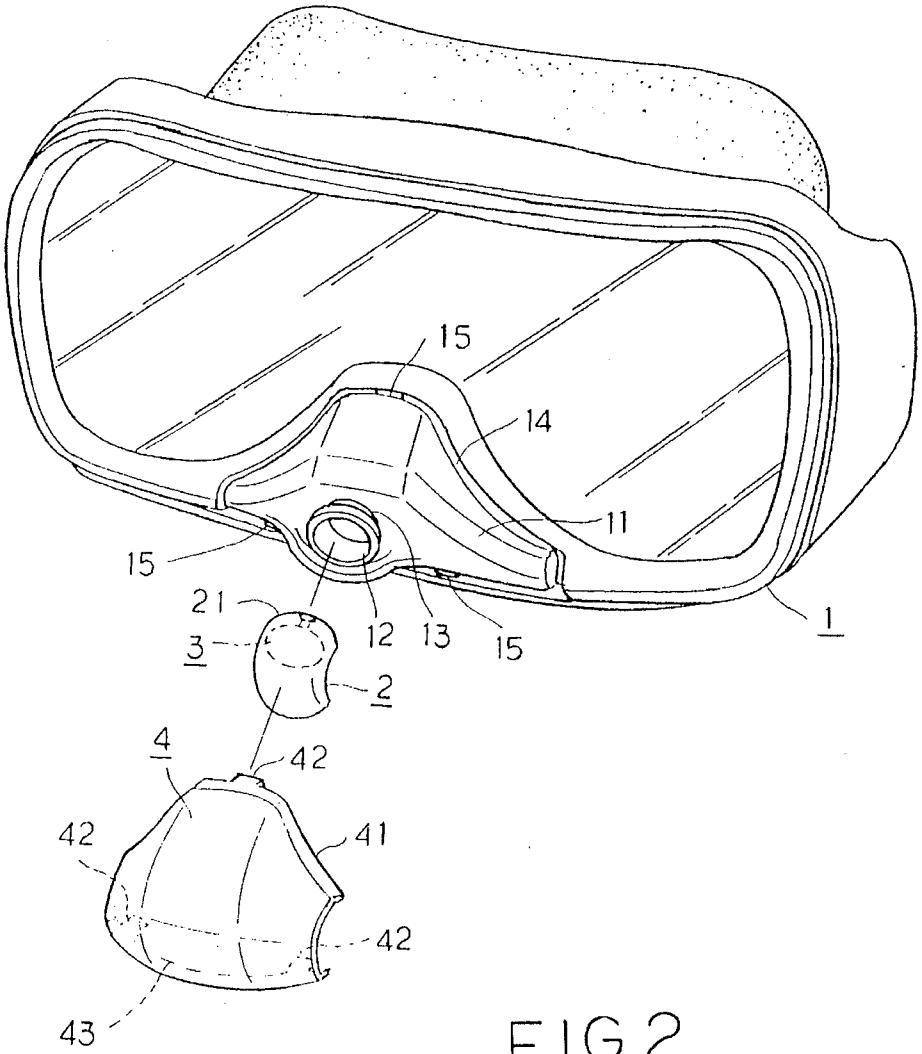
FIG. 2 is an exploded view of the diving mask with a structure for a drain and flow guide in accordance with the present invention.
Figure 3:
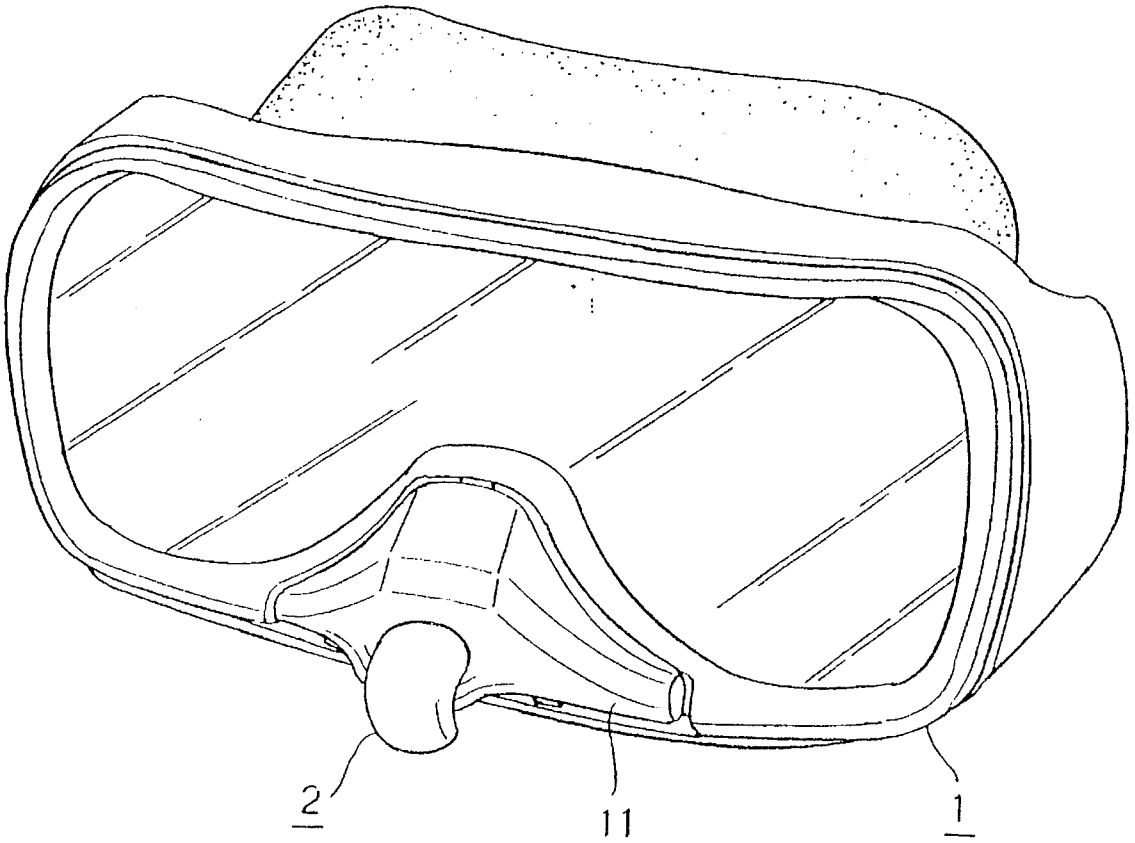
FIG. 3 is a perspective view of the combination of frame body and flow guide tube as shown in FIG. 2.
Figure 4:
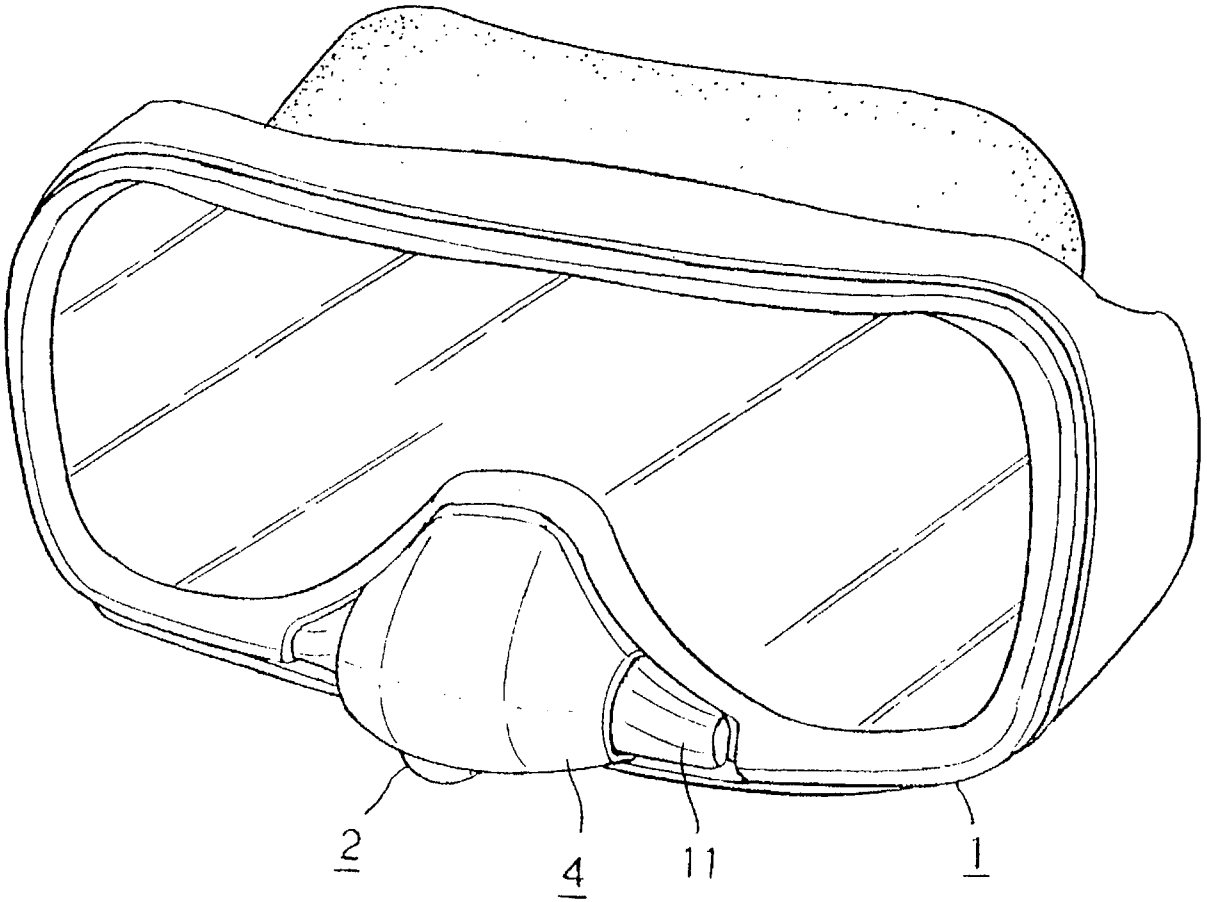
FIG. 4 is a perspective view of the diving mask as shown in FIG. 2.
Figure 5:
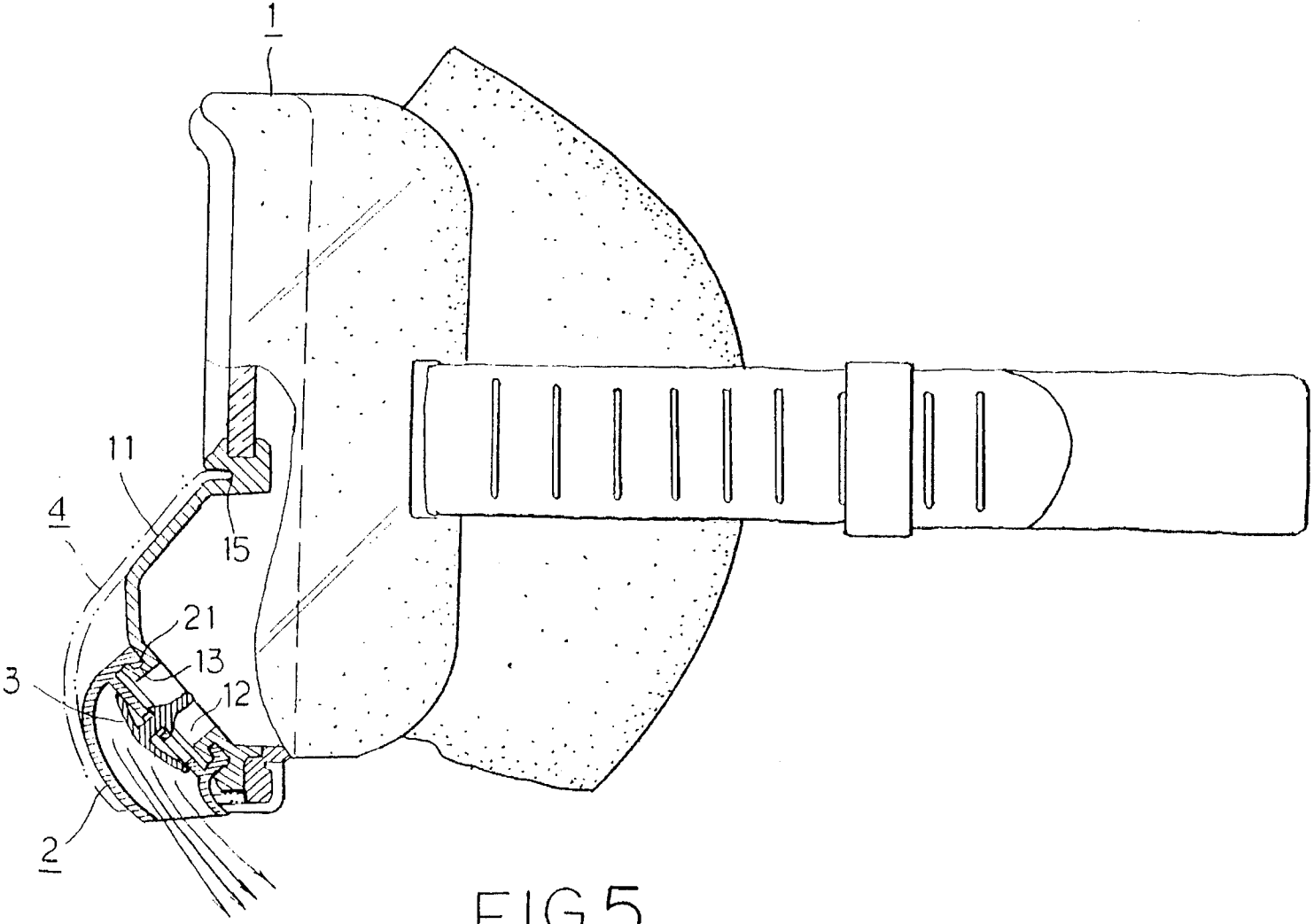
FIG. 5 is a section view of the combination of the diving mask with a structure for a drain and flow guide in accordance with the present invention.

As shown in FIGS. 2 to 5, the present invention is essentially an improvement and innovation of the structure for a drain and flow guide of a diving mask.

The diving mask has a frame body 1 with a nose 11 of which the lower front forms a drain port 12. A flow guide tube 2 is connected to the drain port 12 and a concave neck 13 is formed on the outer edge of drain port 12 to be engaged with an inner lip edge 21 at one end of the flow guide tube 2. Another end (outlet end) of the guide tube 2 is bent toward and disposed on the lower edge of nose 11. The flow guide tube 2 or the drain port 12 is provided with a check drain valve 3 (which is provided to the flow guide tube 2 in the example) capable of being opened outward but never inward, to wit, to drain the water but never to let water seep in.

The foregoing flow guide tube 2 can be shaped like a bent tube with a varying diameter. For instance, the opening at the front end of the tube is round but the opening at the outlet end of the tube is flat. The flow guide tube 2 is affixed to and extended outward from the drain port 12.

In addition, a fixing cover 4 is provided to cover and fix the flow guide tube and cover and engage it with the nose 11. The circumference of the cover 4 is provided with a rib 41 and lugs 42 which are received in a groove 14 and recesses 15 in the perimeter of nose 11 so that the fixing cover 4 covers the nose 11. The flow guide tube 2 is further stably engaged with the nose 11 by a portion of the interior 43 of the fixing cover 4 covering and fixing the flow guide tube 2.

According to the present invention, in the course of using the diving mask, water accumulated in the diving mask through seepage can be blown out from the drain port 12 and the flow guide tube 2 by the diver's exhalation. The flow guide tube 2 is extended from the drain port 12 and able to control and guide the water and air so that they will not diffuse but can be concentrated and smoothly guided to drain (akin to the action of a blow pipe). The diver therefore needs to blow out less often and with less force to drain the water in the mask, thereby greatly increasing the convenience of the mask.

We claim:

1. A diving mask with a structure for a drain and flow guide comprising:

a frame body with a nose, a drain port on a lower front portion of said nose, a flow guide tube connected at a first end to said drain port and extending outward from said drain port, and an outlet end of said flow guide tube bent toward a lower edge of said nose, and a check drain valve; such that a control and flow guide action of said flow guide tube restricts diffusion of water and air blown out by a diver so that said water and air drains smoothly from said diving mask.

2. The diving mask of claim 1 wherein:

said flow guide tube is bent with a varying diameter, a cross section of said flow guide tube at a first end is round, and a cross section of said flow guide tube at said outlet end is flat on top and bottom sides thereof.

3. The diving mask of claim 1 wherein:

said drain port and said flow guide tube are engaged by means of a concave neck on an outer edge of said drain port and an inner lip edge at said first end of said flow guide tube.

4. The diving mask of claim 1 wherein:

said diving mask further comprises a fixing cover to cover and fix said flow guide tube and to cover and engage said nose.

5. The diving mask of claim 4 wherein:

said fixing cover comprises a cover body with a rib and at least one lug, said nose comprises a groove and at least one recess to receive respectively said rib and said at least one lug, and said flow guide tube is further engaged with said nose by means of a portion of an interior of said fixing cover covering and fixing said flow guide tube.

* * * * *